US006540959B1

(12) United States Patent
Reinhard et al.

(10) Patent No.: US 6,540,959 B1
(45) Date of Patent: Apr. 1, 2003

(54) VAPOR-PHASE CORROSION INHIBITORS AND METHODS FOR THEIR PRODUCTION

(75) Inventors: Georg Reinhard, Dresden (DE); Gerhard Hahn, Hann. Münden (DE); Signe Lautner, Dresden (DE); Urte Ludwig, Dresden (DE)

(73) Assignee: EXCOR Korrosionsforschung GmbH (DE)

( * ) Notice: Subject to any disclaimer, the term of this patent is extended or adjusted under 35 U.S.C. 154(b) by 0 days.

(21) Appl. No.: 09/358,283

(22) Filed: Jul. 21, 1999

(30) Foreign Application Priority Data

Jul. 29, 1998 (DE) ..... 198 34 226

(51) Int. Cl.[7] ..... C23F 11/02

(52) U.S. Cl. ..... 422/8; 422/10; 252/390; 252/391; 252/393

(58) Field of Search ..... 422/9, 8, 10; 252/390, 252/391, 393, 392, 396

(56) References Cited

U.S. PATENT DOCUMENTS

| | | | | |
|---|---|---|---|---|
| 2,419,327 A | | 4/1947 | Wachter et al. | |
| 2,432,839 A | | 12/1947 | Wachter et al. | |
| 2,432,840 A | | 12/1947 | Wachter et al. | |
| 2,941,953 A | | 6/1960 | Hatch | |
| 3,295,917 A | | 1/1967 | Cotton et al. | |
| 3,836,077 A | | 9/1974 | Skildum | |
| 3,887,481 A | | 6/1975 | Korpics | |
| 3,967,926 A | | 7/1976 | Rozenfeld et al. | |
| 4,051,066 A | | 9/1977 | Miksic et al. | |
| 4,124,549 A | | 11/1978 | Hashiudo et al. | |
| 4,275,835 A | | 6/1981 | Miksic et al. | |
| 4,290,912 A | | 9/1981 | Boerwinkle et al | |
| 4,973,448 A | | 11/1990 | Carlson et al. | |
| 5,209,869 A | | 5/1993 | Miksic et al. | |
| 5,332,525 A | | 7/1994 | Miksic et al. | |
| 5,393,457 A | | 2/1995 | Miksic et al. | |
| 5,958,115 A | * | 9/1999 | Bottcher et al. | 422/9 X |

FOREIGN PATENT DOCUMENTS

| | | |
|---|---|---|
| DE | 814 725 | 8/1951 |
| DE | 877 086 | 9/1952 |
| DE | 1 521 900 | 10/1964 |
| DE | 1 182 503 | 11/1964 |
| DE | 32 10 360 A1 | 12/1982 |
| DE | 35 45 473 A1 | 7/1987 |
| DE | DD 268 978 B1 | 6/1989 |
| DE | DD 284 255 A5 | 11/1990 |
| DE | DD 295 668 A5 | 11/1991 |
| DE | DD 298 662 A5 | 3/1992 |
| DE | 40 40 586 A1 | 6/1992 |
| DE | 197 08 285 A1 | 9/1998 |
| EP | 0 639 657 A1 | 2/1995 |
| EP | 0 662 527 A1 | 7/1997 |
| JP | 56122884 A | 9/1981 |
| JP | 58063732 A | 4/1983 |
| JP | 61015988 | 1/1986 |
| JP | 61227188 A | 10/1986 |
| JP | 62063686 A | 3/1987 |
| JP | 62109987 | 5/1987 |
| JP | 63028888 A | 2/1988 |
| JP | 63183182 A | 7/1988 |
| JP | 63210285 A | 8/1988 |
| JP | 02085380 | 3/1990 |
| JP | 03079781 | 4/1991 |
| JP | 09228078 A | 9/1997 |

OTHER PUBLICATIONS

A. D. Mercer, Proc. of the 7$^{th}$ Europ. Symp. on Corrosion+ Inhibitors, Ann. Univ. Ferrara/Italy, N.S. Sez. V, Suppl. N. 9, (1990), p. 449 ff.

"Verpackungs–Rundschau" May 1988, p. 37 ff. (English Summary).

* cited by examiner

*Primary Examiner*—Elizabeth McKane
(74) *Attorney, Agent, or Firm*—Schnader Harrison Segal & Lewis LLP

(57) ABSTRACT

The invention concerns combinations of substances with (1) an aromatic mercaptothiazole or triazole, (2) a multiple substituted phenol insoluble in water, (3) L ascorbic acid or one of its salts and possibly (4) a suitable carboxylic acid/salt pair that after sublimation and condensation on metal surfaces can stabilize the pH value of a condensed water film in the range $4.8 \leqq pH \leqq 6.5$ (referred to 25° C.), and use of the combinations of substances as vapor-phase corrosion inhibitors in packaging or for storage in closed spaces for protecting preferably metals that cannot be passivated, like copper, silver, manganese, magnesium and their alloys, against atmospheric corrosion.

16 Claims, No Drawings

VAPOR-PHASE CORROSION INHIBITORS AND METHODS FOR THEIR PRODUCTION

FIELD OF THE INVENTION

The invention relates to combinations of substances that can be used as vapor-phase corrosion inhibitors (volatile corrosion inhibitors, VCIs) in particular to protect non-ferrous metals or metals that cannot be passivated, like copper, silver, manganese, magnesium and their alloys, against atmospheric corrosion.

BACKGROUND

It is already generally known that corrosion inhibitors which in powder form tend to sublimate under normal conditions, and through which vapor phases can penetrate to metal surfaces that are to be protected, are used for temporary corrosion protection of metal objects in closed areas, eg in packaging or showcases.

As a rule these vapor-phase inhibitors (VPIs) or volatile corrosion inhibitors (VCIs) are selected according to the type of metal to be protected and used as powder, packed in bags of a material that is permeable to the vaporous VPIs (cf H. H. Uhlig, Corrosion and Corrosion Protection (German), Akademie-Verlag Berlin, 1970, pp 247–249; K. Barton, Protection against Atmospheric Corrosion—Theory and Practice (German), Verlag Chemie, Weinheim, 1973, p 96 ff; I. L. Rozenfeld, Corrosion Inhibitors (Russian), Izt-vo Chimija, Moscow, 1977, p 320 ff).

Modern means of packaging for corrosion protection contain VCIs either in pellet form in porous foam plastic capsules or as fine powder inside polymeric carrier materials. Thus, in the patents U.S. Pat. Nos. 3,836,077, 3,967,926, 5,332,525, 5,393,457, 4,124,549, 4,290,912, 5,209,869, JP 4,124,549, EP 0.639.657 and DE-OS 3.545.473, different variants are suggested for incorporating VCIs in pellets or plastic films permeable to air, either by enclosing them in cavities created by opening up foam plastic and then covering them by a material permeable to gas or by adding the VCIs to the polymer melt intended for blow extrusion or injection molding so that a packaging material (film or hard substance) results from which the VCI components can continuously sublimate because of the structural porosity.

Attempts have already been made to work in the VCIs during the expansion of polymer solids, as described for example in JP 58.063.732, U.S. Pat. No. 4,275,835 and DD 295.668. Furthermore, packaging containing VCIs can be produced by dissolving the VCI components in a suitable solvent and depositing them on the particular packaging material. Methods of this kind with different active components and solvents are described for example in JP 61.227.188, JP 62.063.686, JP 63.028.888, JP 63.183.182, JP 63.210.285, DE-PO 1521900 and U.S. Pat. No. 3,887,481.

But, given the fact that the VCI packaging material produced in this way usually contains the active components only loosely in the structural cavities of the carrier material, paper, cardboard and foam plastic, etc, there is danger of mechanical spreading and spilling of the active particles so that it is not possible to ensure that the pretreated carrier materials at all possess the necessary specific surface concentration of VCIs when they are used for corrosion protection.

To eliminate this drawback, DE-PS 19708285 describes a corrosion-inhibiting composite material that consists of a mixture of a metallic oxide sol, the corrosion inhibitors capable of sublimation and further additives and forms a firmly adhering, sufficiently porous gel film of the used metal oxides and additives on the carrier material from which the corrosion inhibitors (VCIs) are released at a steady, long lasting rate of emission.

According to the ISO definition, a corrosion inhibitor is a "chemical substance which decreases the corrosion rate when present in the corrosion system at a suitable concentration without significantly changing the concentration of any other corrosive agent; the use of the term inhibitor should be qualified by the nature of the metal and the environment in which it is effective" (see "Corrosion of metals and alloys—Terms and definitions", ISO 8044, 1986).

The major principle of using VCIs is to maintain or reinforce the inherent primary oxide layer, usually offering only limited protection, that forms very fast on every metal through contact with the atmosphere but cannot be perceived without optical aids (K. Barton, loc. cit.).

As regards the nature and properties of the mentioned primary oxide layer, the familiar commodity metals and their alloys can be divided into two categories, those where a sufficiently strong oxidizer is needed to maintain the protective primary oxide layer, and those where the passive oxide layer undergoes such chemical and/or structural changes through the action of an oxidizer that adhesion to the substrate and thus also the protective effect against corrosion are lost.

Among iron materials the primary oxide layer consists for the most part of an Fe (III) oxide. If the metal surface becomes damp, as is the case, for example, when a water film condenses, without the simultaneous action of a sufficiently strong oxidizer, then corrosion of the metal commences through transformation of these oxides into Fe (II) compounds, eg:

$$Fe_2O_3+H_2O+2H^++2e^-\rightarrow 2Fe(OH)_2$$

and where, for the anodic corrosion of the substrate metal:

$$Fe+2H_2O\rightarrow Fe(OH)_2+2H^+2e^-$$

To avoid this, the action of a sufficiently strong oxidizer is necessary. Nitrites and, in particular, the relatively readily volatile dicyclohexyl ammonium nitrite have consequently been used for more than 50 years as vapor-phase inhibitors (cf Uhlig, Barton, Rozenfeld, loc. cit.) and are named as a constituent of VCI compositions in numerous patents (eg U.S. Pat. Nos. 2,419,327, 2,432,839, 2,432,840, 4,290,912, 4,973,448, JP 02085380, JP 62109987, JP 63210285 A, DE-PS 4040586).

The metals whose primary oxide layer is sensitive to further oxidation include e.g. copper, silver and manganese.

In Cu and Cu base materials the primary oxide film consists mainly of the oxide $Cu_2O$ for example. This film is only stable in hydrous media free of oxidizers, independently of the pH value. Exposed to the effect of oxygen, the oxide CuO is produced relatively fast, which is perceivable as a black deposit that, because of its crystal lattice dimensions, cannot intergrow with the metal substrate (no epitaxy) and therefore does not guard against corrosion. The initiating reactions of atmospheric corrosion can be formulated as follows:

$$Cu_2O + H_2O \longrightarrow 2\,CuO + 2\,H^+ + 2\,e^-$$

$$\tfrac{1}{2}\,O_2 + 2\,H^+ + 2\,e^- \longrightarrow H_2O$$

$$Cu_2O + \tfrac{1}{2}\,O_2 \longrightarrow 2\,CuO$$

For the creation of VCI packaging means that cannot only be used for a certain kind of metal but that are also multivalent, it was attempted to formulate VCI combinations that contain not only amine nitrites but also components which are able to protect heterogeneous cast materials and precisely those metals like copper and silver base materials against corrosion.

In the course of this it was proposed to combine nitrites with further substances capable of sublimation, like the salts of medium-strength to weak, saturated or unsaturated carboxylic acids (cf U.S. Pat. No. 2,419,327, 2,432,839, 2,432,840, DE 814.725). Although this produces protection of the common Al, Sn and Zn materials, corrosion of Cu and Mg materials in the same packaging is further promoted.

The cause of this is found in the existence of nitrite, which cannot only oxidize the primary oxide layer of the copper but reduces to ammonia $NH_3$ when acting as an oxidizer. This $NH_3$ can, on the one hand, transform the oxidic passive layer of the copper metals into soluble complexes and, on the other, create such high alkalization on Mg surfaces when humidified that a soluble magnesium hydroxo complex is produced from the existing MgO film. In both cases this means a loss of the passive state and consequently the beginning of corrosion (cf A. D. Mercer, Proc. of the 7th Europ. Symp. on Corrosion Inhibitors, Ann. Univ. Ferrara/Italy, N. S., Sez. V, Suppl. N. 9 (1990), 449 pp).

To eliminate this drawback, VCI systems were proposed that are to be suitable for corrosion protection of any metal combinations but are to make do without nitrite and amines by being composed solely of combinations of organic carboxylic acids and their salts, as for example in DE-OS 877.086, CS-PS 124.738 and PL-PS 96.548. But in general this does not result in dependable corrosion protection, because the rate of sublimation is comparatively low and reduces even more with increasing relative humidity.

To eliminate this drawback, it was proposed to combine salts like benzoates with a readily volatile amine and thus accelerate the exit velocity of the VCIs from the packaging serving as a depot. Thus U.S. Pat. No. 4,124,549, for example, speaks of combinations of dicyclohexylamine with benzoic acid and/or caprylic acid as well as the analog combinations monoethanolamine laurate and morpholine benzoate, while DE-OS 3219360 claims use of morpholine caprylate. JP 61227188 specifies the salts of tertiary amines like dimethylethanolamine caprylate mixed with hexamethylene tetramine, while JP 09228078 considers cyclohexyl cyclohexamine, cyclohexyl benzenamine and other homologs that, furthermore, when dissolved in propanol can be deposited on paper as a carrier material or can even be used as a readily volatile corrosion-inhibiting fluid. Instead of the combination of carboxylic acid salts with amines, DE-OS 3210360 names mixtures of fatty alcohol phosphates with volatile amines as VCIs, eg mixtures of Di(2-ethylhexyl) hydrogen phosphate and Di(9-octadecenyl) hydrogen phosphate with morpholine or morpholine caprylate.

Practical uses of such systems have been lacking to date however, probably and chiefly because laboratory experiments proved that they do not produce reliable corrosion protection effects for multi-metal combinations, since the usual kinds of steel in particular cannot be guarded against corrosion if the VCI system does not contain any oxidizer functioning as a passivator, and, as a result of the relatively high alkalization produced by the named substances on metal surfaces in humid air, the primary oxide layers found on copper, aluminum, zinc and magnesium become more complex, thus contributing to canceling the passive state.

Furthermore, copper and silver materials are not protected against corrosion by these combinations of substances anyway if the usual impurities of industrial air, eg carbon dioxide, sulfur dioxide, hydrogen sulfide, are present at the same time in the atmosphere of the inner space of the particular packaging. These metals are after all characterized by the fact that they have a higher affinity to sulfidic sulfur than to oxygen, and the blackish brown tarnishing film on silver is ascribed to formation of the silver sulfide $Ag_2S$.

Benzotriazole has long been in use for protecting copper and copper alloys against atmospheric corrosion (cf Barton, Mercer, loc. cit.). But, seeing as the tendency of this compound to sublimate is relatively low, DE-PS 1182503 and U.S. Pat. No. 3,295,917 suggest first setting the depot of this VCI to a higher temperature (up to approx. 85° C.) and at the same time cooling the metal objects on which condensation is to occur. U.S. Pat. Nos. 2,941,953 and 3,887,481, on the other hand, describe the impregnation of paper with benzotriazole and/or tolyltriazole. Organic solvents like tetrachlorethylene are used and it is specified that the metal parts to be protected should be enclosed as tightly and densely as possible with the impregnated VCI packaging in order to keep the space between the VCI depot and the protected metal surface as small as possible. However, this technology exhibits the disadvantage, already mentioned, that the active component in the form of extremely fine powder particles does not adhere very well to the paper and can easily trickle down, so the corrosion protection properties of this packaging cannot be considered reliable.

The tendency of benzotriazole and tolyltriazole to sublimate from a VCI depot likewise increases if further solids in powder form are worked in that are capable of sublimation. For this purpose EP 0662527 speaks of mixtures of benzotriazole with cyclohexylamine benzoate and ethylamine benzoate or with anhydrous sodium molybdate and dicyclohexylamine nitrite, U.S. Pat. Nos. 4,051,066 and 4,275,835 describe mixtures of benzotriazole with ammonium and amine molybdates, amine benzoates and nitrates, U.S. Pat. No. 4,973,448 addresses mixtures of benzotriazole with organic carbonates, phosphates and amines, while JP 62063686 and JP 63210285 A detail mixtures of benzotriazole with alkali and amine salts of aromatic carboxylic acids.

Combinations of benzotriazole, tolyltriazole or methylbenzotriazole with other nitrogenous organic, volatile solids are described in JP 62109987, JP 61015988, DD-PS 268978 and DD-PS 298662 for example. A disadvantage is the fact that all components containing ammonium ions and amines, because of their more or less pronounced tendency to conjugate with metal ions, again reduce the protective effect of triazoles especially in the case of non-ferrous metals. Furthermore, the stated amines and ammonium compounds are highly hydrophilic. VCI depots containing such substances consequently tend very much to absorb water. Because of their hydrolysis this is usually followed by a stronger drop in their tendency to sublimate, meaning automatically a reduction in the corrosion protection effect.

For these reasons JP-PS 56122884 A, for example, suggests, as an alternative, dispensing with additives containing amines and only using triazoles. But, to avoid having to wait for the triazole to sublimate from the packaging functioning as a VCI depot and be adsorbed on the metal surface to be protected, it is proposed that these inhibitors, dissolved in a suitable halogenated hydrocarbon, be sprayed direct onto the metal parts from spray bottles. These spray fluids are recommended in JP-PS 56122884 A especially for corrosion protection of copper materials and other alloy materials in electronic systems and printed microelectronic circuits. This kind of application of corrosion inhibitors no longer makes use of the advantages of the principle of volatile corrosion inhibitors (VCIs) however, instead it presents the disadvantage that, in addition to the packaging (encapsulating) process for the electronic components, spraying makes an extra operation necessary.

In order to make use of the advantages of VCIs and the inhibitor effect of the triazole structure, JP-PS 03079781 suggests using only alkylamine triazoles instead of triazole/amine combinations. The explicitly stated substances 3-amino-1,2,4-triazole and 3-amino-5-methyl-1,2,4-triazole do in fact exhibit a higher rate of sublimation but, especially where copper and silver are concerned, not such a marked corrosion protection effect as benzotriazole and tolyltriazole.

As an alternative to the triazoles, DD 284255 quite globally speaks of the use of indole or imidazole derivatives to protect non-ferrous metals against corrosion. But there are neither details of the type and concentration of such additives, nor is their protective effect substantiated by concrete data.

It would therefore be advantageous, compared to the drawbacks of conventional corrosion inhibitors as described above, to provide improved corrosion-inhibiting substances and combinations of substances that are capable of sublimation and which, especially in the climatic conditions of practical interest inside technical packaging and analogous closed spaces, sublimate from a depot with sufficient speed and, after adsorption and/or condensation on the surface of metals located in such areas, produce conditions in which, in particular, non-ferrous metals like copper, silver, manganese, magnesium and their base alloys, rated as incapable of passivation, can be effectively protected against atmospheric corrosion. It would further be advantageous to provide methods for producing or processing such substances and combinations of substances for the manufacture of improved VCI packaging.

SUMMARY OF THE INVENTION

This invention relates to a corrosion-inhibiting combination of substances, capable of sublimation, that contains (1) aromatic mercaptothiazole or triazole, (2) multiple substituted phenol insoluble in water, (3) L ascorbic acid or one of its salts, and (4) a carboxylic acid/salt pair.

DETAILED DESCRIPTION

Surprisingly, the drawbacks of conventional corrosion inhibitors have been solved by the invention in particular by combinations of substances made up of the following components:

(1) aromatic mercaptothiazole or triazole, (2) multiple substituted phenol insoluble in water, and (3) L ascorbic acid or one of its salts.

Harmonized with the components (1) through (3), a suitable carboxylic acid/salt pair may possibly be added as component (4). The carboxylic acid/salt pair is chosen so that, after its sublimation and condensation on metal surfaces, the pH value of a condensed water film is stabilized (buffered) there in the range $4.8 \leqq pH \leqq 6.5$.

The invention foresees direct use of these combinations of substances in the form of appropriate powder mixtures or inclusion by already familiar methods as part of producing VCI packaging so that this packaging functions as a VCI depot and the corrosion protection properties of the combinations of substances according to the invention can show to special advantage.

The combinations of substances according to the invention are used above all to protect metals that are considered as being incapable to be passivated, eg copper, silver, manganese, magnesium and their alloys, in packaging and during storage in analogous closed spaces against atmospheric corrosion.

A subject of the invention is in particular a corrosion-inhibiting material consisting of a component that is an aromatic mercaptothiazole or triazole and is specifically adsorbed above all on surfaces of non-ferrous metals, a further component that is a multiple substituted phenol and, as a result of its properties of not being soluble in water but easily adsorbed by solids, hydrophobizes all other components of the combinations of substances according to the invention and, because of its relatively high sublimation pressure, transports them as a carrier material through the gas space to the metal surface to be protected, a component that is L ascorbic acid or one of its salts and, because of its property of working as an anti-oxidant, surprisingly inhibits the effect of atmospheric oxygen on metal surfaces and thus the corrosion process, and finally a suitable carboxylic acid/salt system that, in condensed water films on metal surfaces, stabilizes the pH value in the range $4.8 \leqq pH \leqq 6.5$ where the previously named components of the combinations of substances according to the invention can optimally demonstrate their corrosion protection effect. The combinations of substances according to the invention advantageously consist exclusively of non-toxic substances that are no danger to the environment and can be processed easily and without risk by already familiar methods. Consequently they are especially suitable for producing corrosion-protective packaging that is inexpensive on a large scale and can be used without posing any risk.

For inclusion of the combinations of substances according to the invention in VCI depots or in packaging functioning as such, it is best to first finely mill the individual substances down to particle sizes of $\leqq 20\ \mu m$, then thoroughly dry them and finally mix them as intensively as possible by familiar methods.

The combinations of substances according to the invention should be formulated in the following relations:

component (1): 10 to 40% component (2): 10 to 40% component (3): 10 to 40% or if all four components are used:

component (1): 10 to 40% component (2): 10 to 35% component (3): 10 to 30% component (4): 10 to 30%

Selected aspects of the application are explained in more detail through the following examples. As will be seen, the nature and proportions of the individual components in the mixture according to the invention and the proportion of the mixture in the particular VCI depot depend both on the metal to be protected and on the conditions for producing the particular VCI packaging.

EXAMPLE 1

The following combination of substances according to the invention was prepared from the predried, powdery substances:

25 mass % mercaptobenzothiazole
20 mass % 2,6 Di tert. butyl-4-methoxyl-phenol
15 mass % L ascorbic acid
12 mass % sodium benzoate
8 mass % benzoic acid
20 mass % inert filler (silica gel)

10 g of this mixture were spread out in a flat dish and this was placed in a larger vessel of glass. This flat, rectangular glass vessel contained at the same time, next to each other and without touching, clean plates (30×50 mm) of Cu, Ms63, MnFe20, Ag99 and MgAl3, free of tarnishing film and deposits. The condition of the plates could be judged by measuring the gloss through the top of the vessel sealed by non-reflecting glass. The measuring system "GLOSScomp/OPTRONIK Berlin" used for this purpose records the reflection curve composed of direct and diffuse reflection components, whose peak P/dB is sufficiently representative of the nature of the metal surface.

A loss of gloss caused by first tarnishing film or other corrosion effects always becomes noticeable in smaller values of P referred to the fixed initial state. To indicate that such changes have taken place which the naked eye can barely perceive without optical aids, it is sufficient to determine ΔP/%.

The vessel with the metal samples and the combination of substances according to the invention was tightly sealed and the initial data P/dB of the individual metal samples were determined through the top. After 5 h the inlet and outlet to a reservoir on the side walls of the vessel were opened, this reservoir containing a saturated Di sodium hydrogen phosphate solution. The air above this solution was then circulated by means of a circulating pump through the vessel with the metal samples and the mixed substances according to the invention to produce a uniform relative humidity (RH) of ≈95%. The ΔP/% was recorded for each metal sample at regular intervals of approx. 5 h. All metals named exhibited $0 \leqq \Delta P/\% \leqq +0.5$ during an experiment period of 25 d. This means that their metal gloss appearance in the humid air saturated by the combination of substances according to the invention remained unaltered.

When metal samples of the same kind were exposed alone, ie in pure humid air without a combination of substances according to the invention, it was possible to detect a reduction in gloss with increasing time of exposure $t_E$, characterized by negative ΔP/% values and dependent on the type of metal:

| | ΔP/% | | | | |
|---|---|---|---|---|---|
| $t_E$/h | Cu | Ms63 | MnFe20 | Ag99 | MgAl3 |
| 8 | −0.4 | −0.2 | −0.9 | −0.2 | −0.3 |
| 24 | −1.6 | −1.0 | −2.4 | −0.5 | −1.3 |
| 48 | −2.1 | −1.4 | −3.6 | −1.1 | −3.5 |

This example illustrates the beneficial effect of the combination of substances according to the invention.

EXAMPLE 2

The following combination of substances according to the invention was prepared from the predried, powdery substances:

28.5 mass % benzotriazole
17.3 mass % 2,6 Di tert. butyl-4-ethyl-phenol
17.1 mass % L ascorbic acid
28.5 mass % potassium hydrogen phthalate
8.6 mass % phthalic acid and a 5% solution of this was produced in ethanol (90%)/water.

An aqueous alcoholic, acidic sol, produced according to DE-PS 19708295 from 50 ml tetraethoxysilane, 200 ml ethanol and 100 ml 0.01N hydrochloric acid by 20 h of stirring at room temperature and which then had 4.2% solids content in 70% ethanol at pH≈4, was mixed with 50 ml of the 5% solution of the combination of substances according to the invention and used to coat paper (kraft paper 70 g/m$^2$) by wet rolling. Immediately after drying the VPI paper produced in this way in air, it was tested for its corrosion protection properties by comparison with a conventional vapor-phase inhibitor paper serving as a reference system (R1) by the usual method for "Testing the corrosion protection effect of VPI packaging" (cf Verpackungs-Rundschau May 1988, p 37 ff). According to a chemical analysis the reference system (R1) contained the active components dicyclohexylamine, cyclohexylamine, benzotriazole and sodium molybdate, whereby the total proportion was approximately comparable to that of the combination of substances according to the invention. Test specimens of the metals Cu, MnFe20 and MgSi2 were used. These were pretreated as specified and their initial state characterized by the "GLOSScomp" gloss testing system mentioned in example 1 immediately before being put into the sample vessel. Then these test specimens were put alone or together with the VPI packaging means to be tested into tightly sealed vessels and conditions were created to produce water condensation on the surface of the test specimens. The polished surface of the test specimens was regularly examined visually for the existence of signs of corrosion.

The blank specimens of Cu used without VPI showed a slight black coloring after 4 d, the samples of the MnFe20 alloy already had a thin, dark brown tarnishing film after 48 h, while the surface of the Mg material appeared slightly tarnished. The test specimens of Cu exposed together with the R1 paper already showed stronger discoloration after about 24 h, at the same time the samples of MnFe had tarnished more intensively dark brown, and the magnesium alloy had initial, small white blemishes. Upon use of the paper bearing the combination of substances according to the invention, all test specimens still had perfect appearance and the very sensitive "GLOSScomp" testing system recorded values in the range $0 \leqq \Delta P/\% \leqq +0.5$, demonstrating that there had been no changes at all to the surfaces of the test specimens. To date there was no VPI packaging means whose applicability for manganese and/or magnesium materials was explicitly stated. The example demonstrates that those means of packaging prepared by using a combination of substances according to the invention fill this gap for the first time.

EXAMPLE 3

The following combination of substances according to the invention was prepared from the predried, powdery substances:

| | |
|---|---|
| 22.5 mass % | mercaptobenzothiazole |
| 6.0 mass % | tolyltriazole |
| 17.5 mass % | 2,6 Di tert. butyl-4-methyl-phenol |
| 12.1 mass % | L ascorbic acid |
| 8.5 mass % | calcium ascorbate |
| 8.6 mass % | calcium stearate |
| 8.3 mass % | stearic acid |
| 6.2 mass % | zinc oxide (filler) |
| 7.8 mass % | calcium carbonate (slip) |
| 2.5 mass % | silica gel (antiblock) |

35 mass % of this mixture was mixed with 65 mass % of a common LD-PE and worked into a VCI master batch. A Rheocord 90 (HAAKE) extruder with a contra-rotating dual worm was used for this purpose. Extrusion was made at a worm speed of 65 to 80 rpm at cylinder temperatures of about 150° C. and a jet temperature of 158° C., and granulation was made by cold chipping. This granulated VCI master batch was further processed into VCI films by blow extrusion, fitting the extruder with a single worm and ring jet. After mixing 3 mass % of the VCI master batch with 97 mass % of a common LD-PE granulate, the operation used cylinder temperatures of 175° C. and a jet exit temperature of 180° C., the worm speed varying between 80 and 85 rpm. This produced a VCI film with a mean layer thickness of 80 $\mu$m.

The VCI film produced by using a combination of substances according to the invention was processed into bags (cutting and welding of the overlaid edge seams). Plates of the materials Cu, Ms63, MnFe20, Ag99 and MgAl3 were degreased, dried and characterized by "GLOSScomp" and then welded singly into such bags. The alloys Ms63, MnFe20 and MgAl3 packed in this way were cycled in humid air in a conditioning cabinet according to the standard IEC 68-2-30. Here a 24 h cycle consists of the following phases: 6 h at 25° C. and RH=98%, 3 h warmup phase from 25 to 55° C. at RH=95%, 9 h at 55° C. and RH=93%, and 6 h cooling phase from 55 to 25° C. at RH=98%. After each cycle there is visual judgment of the condition of the surface of the test metals through the transparent film material. Following the cycled test the gloss was also tested to determine $\Delta P/\%$. Parallel to this, identical test specimens were packed in pure polyethylene film (R2) of the same layer thickness and also in a conventional VCI film material as a reference system (R3) and likewise deposited in the conditioning cabinet. Chemical analysis showed that (R3) contained the active components ammonium molybdate, triethanolamine and benzotriazole.

In the polyethylene film (R2) free of active components there were slight brown colorings on MnFe20 after only three cycles, initial white precipitation on MgAl3 after five cycles, and the first dark spots on Ms63 after twelve cycles. In the case of the samples packed in (R3) no inhibition of corrosion could be determined for MnFe20 and MgAl3, the described corrosion being even more intensive in part after the same load period. Ms63 was covered with spots after 16 cycles.

The samples packed in the VCI film containing the combination of substances according to the invention still looked perfect in appearance when visually judged after 25 cycles. The gloss tests performed after the climatic stress produced values in the range $0 \leqq \Delta P/\% \leqq +0.5$, thus confirming this result.

The materials Cu and Ag99 welded into the VCI film containing the combination of substances according to the invention were stored in a closed glass vessel over a saturated disodium hydrogen phosphate solution, also containing 0.03 mass % of ammonium sulfide. This solution, as is known, produces relative humidity of 95% in a closed gas enclosure at 25° C. and also emits small quantities of hydrogen sulfide. The metals packed in pure polyethylene already had a thin, dark tarnishing film after 8 h in this humid air containing hydrogen sulfide. The reference film (R3) produced minimal delay of this effect in the case of Ag99 so that the first dark discoloration did not appear until after about 12 h. In the case of Cu in (R3) it took approx. 48 h until the first changes could be perceived visually. The VCI films produced according to the invention still guaranteed their full corrosion protection effect after 20 d stress, again noticeable from the perfect appearance of the test specimens.

The combination of substances according to the invention provides for the first time an effective and easy usable solution especially for protecting silver against the formation of sulfidic tarnish during transportation and storage. 500 round silver blanks, intended for minting coins, were laid singly on paperboard and tightly packed with the film containing the combination of substances according to the invention by a skin process. After storage of three months the condition of all round blanks is still quite perfect, whereas previously, using film (R3), some 20% already had a thin tarnishing film after the same period of time and had to be eliminated.

What is claimed is:

1. Corrosion-inhibiting combination of substances, capable of sublimation, that contains:

(1) aromatic mercaptothiazole or triazole, (2) multiple substituted phenol insoluble in water, (3) L ascorbic acid or one of its salts, and (4) a carboxylic acid/salt pair.

2. The corrosion-inhibiting combination of substances according to claim 1 containing 10 to 40% of component (1), 10 to 40% of component (2) and 10 to 40% of component (3).

3. The corrosion-inhibiting combination of substances according to claim 1 containing 10 to 40% of component (1), 10 to 35% of component (2), 10 to 30% of component (3) and 10 to 30% of component (4).

4. The corrosion-inhibiting combination of substances according to claim 1 in which the carboxylic acid/salt pair is chosen so that, after its sublimation and condensation on metal surfaces, the pH value of a condensed water film lies in the range $4.8 \leqq pH \leqq 6.5$ (referred to 25° C.).

5. The corrosion-inhibiting combination of substances according to claim 1 in which benzoic acid/Na benzoate, phthalic acid/potassium hydrogen phthalate, stearic acid/alkali or alkaline earth stearate or other carboxylic acid/salt pairs with similar protolytic properties are contained as the carboxylic acid/salt pair.

6. The corrosion-inhibiting combination of substances according to claim 1 that contains mercaptobenzothiazole, methyl mercaptobenzothiazole, benzotriazole, tolyltriazole or their mixtures as the aromatic mercaptothiazole or triazole.

7. The corrosion-inhibiting combination of substances according to claim 1 that contains 2.4 Di tert. butyl-4-methyl-phenol, 2,6 Di tert. butyl-4-ethyl-phenol, 2,6 Di tert. butyl-4-methoxy-phenol, 2,6 Di-octadecyl-4-methyl-phenol, 4-(1,1,3,3-tetramethylbutyl)-phenol, 2 or 6 tert. butyl-4-methyl-phenol or a multiple substituted phenol alone or as mixture thereof as the multiple substituted phenol insoluble in water.

8. The corrosion-inhibiting combination of substances according to claim 1 that contains L ascorbic acid, sodium, potassium or calcium ascorbate alone or as a mixture thereof.

9. A method for producing a corrosion-inhibiting combination of substances, capable of sublimation, in which (1) aromatic mercaptothiazole or triazole, (2) multiple substituted phenol insoluble in water, (3) L ascorbic acid or one of its salts, and (4) a carboxylic acid/salt pair are mixed.

10. The method according to claim 9 in which the components are mixed in dry powder form.

11. The method according to claim 9 in which 10 to 40% of component (1), 10 to 35% component of (2), 10 to 30% of component (3) and possibly 10 to 30% of component (4) are mixed.

12. Method according to claim 9 in which the mixed components are added to a metallic oxide sol and this composition is deposited on a carrier material.

13. The corrosion-inhibiting combination of substances according to claim 1, which is a volatile corrosion inhibitor (VPI, VCI) in the form of finely powdered mixtures for packaging or storage of materials.

14. The corrosion-inhibiting combination of substances according to claim 1 incorporated into a coating material and/or colloidal composite material.

15. The corrosion-inhibiting combination of substances according to claim 1, which is a corrosion inhibitor that can be blow extruded or injection molded in the form of finely powdered mixtures with polymer materials as active concentrates (master batches) and flat final products.

16. The corrosion-inhibiting combination of substances according to claim 1, which is a volatile corrosion inhibitor (VPI, VCI) in packaging and storage operations to protect metals that cannot be passivated against corrosion.

* * * * *